United States Patent [19]

Chauvier

[11] Patent Number: 4,463,468

[45] Date of Patent: Aug. 7, 1984

[54] BUMPER FOR AUTOMATIC SWIMMING POOL CLEANING EQUIPMENT

[76] Inventor: Daniel J. V. D. Chauvier, P.O. Box 11325, Selcourt, Springs, South Africa, 1567

[21] Appl. No.: 469,424

[22] Filed: Feb. 24, 1983

[30] Foreign Application Priority Data

Mar. 9, 1982 [ZA] South Africa ..... 82/1560

[51] Int. Cl.[3] ..... E04H 3/20

[52] U.S. Cl. ..... 15/1.7; 15/246; 15/257 A

[58] Field of Search ..... 15/1.7, 325, 257 R, 15/257 A, 246; 128/57

[56] References Cited

U.S. PATENT DOCUMENTS

| | | | |
|---|---|---|---|
| 1,923,689 | 8/1933 | Rosenberg | 15/325 UX |
| 2,969,557 | 1/1961 | Petersen | 15/325 X |
| 4,129,904 | 12/1978 | Pansini | 15/1.7 X |

*Primary Examiner*—Edward L. Roberts

*Attorney, Agent, or Firm*—Herron & Evans Wood

[57] ABSTRACT

A bumper assembly for a swimming pool cleaning device has an elongate carrier element on which are rotatably mounted a plurality of bumper elements.

6 Claims, 4 Drawing Figures

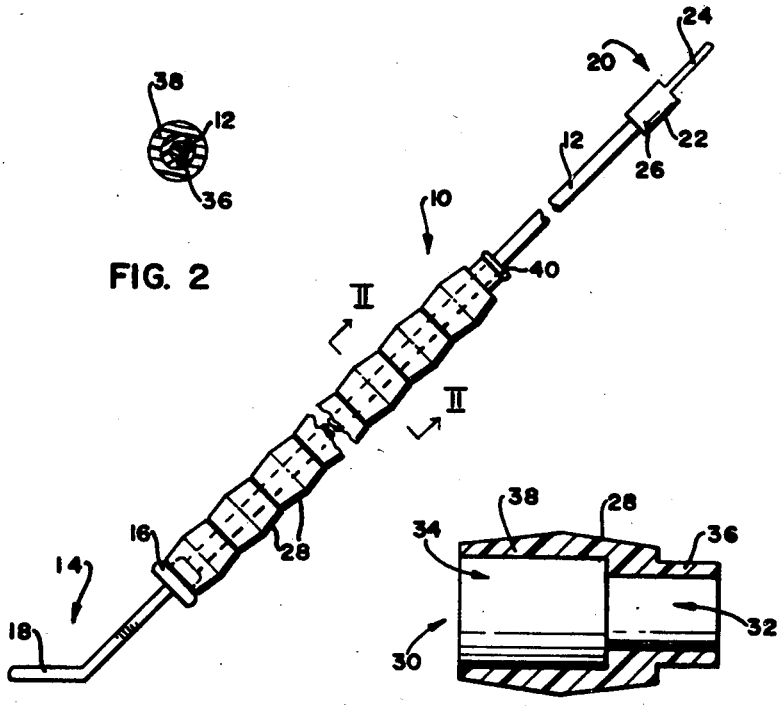
FIG. 2
FIG. 1
FIG. 3
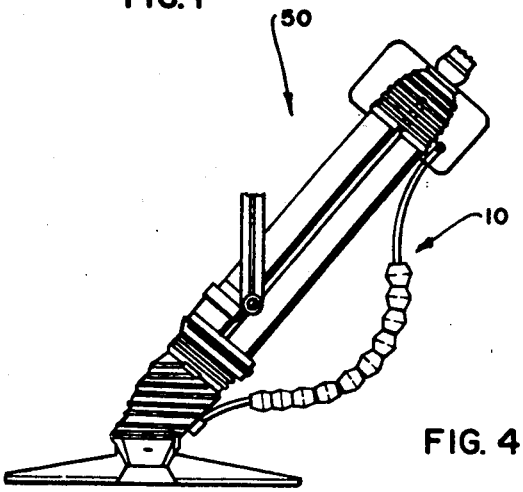
FIG. 4

BUMPER FOR AUTOMATIC SWIMMING POOL CLEANING EQUIPMENT

This invention relates to a bumper assembly for a swimming pool cleaning device and to a swimming pool cleaning device having the bumper assembly.

According to the invention there is provided a bumper assembly for a swimming pool cleaning device which includes a carrier element engageable with the device; and at least one pivotal bumper element pivotally mounted on the carrier element to be pivotally displaceable relative thereto upon engagement with an obstruction in the swimming pool.

The bumper assembly may include a plurality of bumper elements that may be rotatably mounted on the carrier element.

The carrier element may be elongate and may define a longitudinal axis about which the bumper elements may be rotatable.

Further, the carrier element may have a circular cylindrical shaft portion on which the bumper elements may be carried, with the bumper elements having corresponding bores.

Still further, the carrier element may have a collar at one end of the shaft portion and a resiliently flexible securing ring at the other end of the shaft portion for limiting longitudinal displacement of the bumper elements.

One end of the carrier element may have a removable end portion, this end portion having an engaging formation engageable with a complementary formation on the device, and may further have an engaging formation at its other end also engageable with a complementary formation on the device.

Regarding the rotatable elements, the bore of each bumper element may be stepped to define a wider part and a narrower part and each bumper element may have a thin end portion that is received in the wider part of the bore of an adjacent bumper element.

The invention extends to a swimming pool cleaning device which has a bumper assembly in accordance with the invention engaged therewith.

The invention is now described, by way of an example, with reference to the accompanying drawings, in which:

FIG. 1 shows a side view of a bumper assembly in accordance with the invention;

FIG. 2 shows a cross-sectonal view along line II—II in FIG. 1;

FIG. 3 shows a longitudinal sectional view of one of the rotatable elements of the bumper assembly; and FIG. 4 shows a side view of part of a swimming pool cleaner incorporating a bumper assembly with the invention.

Referring to FIG. 1, a bumper assembly in accordance with the invention is shown therein, designated generally by reference numeral 10. It comprises a carrier element 12 that is elongate and has a circular cross-sectional profile along most of its length. Towards its bottom end 14 the carrier element 12 has a collar 16. Further, the bottom end 14 has a flattened portion 18 that is at an angle to the rest of the carrier element 12. It is to be noted that the carrier element 12 is of a suitable resiliently flexible synthetic plastics material. The top end 20 of the bumper assembly 10 is formed by an engaging member 22 which has a flattened end portion 24 and a socket defining portion 26. The socket portion 26 defines a socket in which the upper free end of the carrier element 12 is received.

Mounted on the carrier element 12 are a number of rotatable bumper elements 28. Each bumper element 28 has an internal bore 30. Each bore 30 has a circular cross-sectional profile and is stepped. Each bore 30 has a portion 32, partly defined by a tubular wall portion 36, that has an internal dimension complementary to the external dimension of the carrier element 12. The remaining portion 34 of each bore 30, defined by a wall portion 38 has an internal dimension complementary to the external dimension of the wall portion 36. Thus, the bumper elements 28 can engage one another telescopically, with the wall portion 36 of one bumper element being received in the bore portion 34 of the other. To impede longitudinal movement of the bumper elements 28, a retaining ring 40 is provided.

In use, the member 20 is removed, a suitable number of the bumper elements 28 are slid onto the carrier element 12; the retaining ring 40 is placed in position and the member 22 is reengaged with the upper end of the carrier element 12. The flattened end portions 18 and 24 are then engaged in suitable complementary retaining cavities provided on a swimming pool cleaner 50 with which the bumper assembly 10 is to be used (as shown in FIG. 4).

With a bumper assembly in accordance with the invention, if the swimming pool cleaner engages an obstruction, due to the fact that the bumper elements 28 are rotatable, the cleaner is less likely to get stuck and is more easily able to move around, along or past the obstruction.

I claim:

1. A bumper assembly for a swimming pool cleaning device, said assembly comprising a carrier element connectable with said device, said carrier element being elongate and defining a longitudinal axis, and a plurality of bumper elements rotatably mounted on said carrier element, said bumper elements being rotatable relative to said carrier element's axis upon engagement with an obstruction in a swimming pool.

2. A bumper assembly as claimed in claim 1, in which the carrier element has a circular cylindrical shaft portion on which the bumper elements are carried, with the bumper elements having corresponding bores.

3. A bumper assembly as claimed in claim 2, in which the carrier element has a collar at one end of the shaft portion and a resiliently flexible securing ring at the other end of the shaft potion for limiting longitudinal displacement of the bumper elements.

4. A bumper assembly as claimed in claim 2, in which the carrier element has a removable end portion at one end, this end portion having an engaging formation engageable with a complementary formation on the device, and a further engaging formation at its other end also engageable with a complementary formation on the device.

5. A bumper assembly as claimed in claim 2, in which the bore of each bumper element is stepped to define a wider part and a narrower part and each bumper element has a thin end portion that is received in the wider part of the bore of an adjacent bumper element.

6. An automatic swimming pool cleaning device which has a bumper assembly as claimed in claim 1 engaged therewith.

* * * * *